US010363752B2

(12) United States Patent
Sakai et al.

(10) Patent No.: US 10,363,752 B2
(45) Date of Patent: Jul. 30, 2019

(54) LIQUID DISCHARGE APPARATUS AND LIQUID DISCHARGE METHOD

(71) Applicant: Seiko Epson Corporation, Tokyo (JP)

(72) Inventors: Hirofumi Sakai, Shiojiri (JP); Shinichi Nakamura, Okaya (JP); Junichi Sano, Chino (JP); Takahiro Katakura, Okaya (JP); Keigo Sugai, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/913,066

(22) Filed: Mar. 6, 2018

(65) Prior Publication Data

US 2018/0281443 A1 Oct. 4, 2018

(30) Foreign Application Priority Data

Mar. 28, 2017 (JP) ..... 2017-062693

(51) Int. Cl.
*B41J 2/175* (2006.01)
*B41J 2/18* (2006.01)

(52) U.S. Cl.
CPC ..... *B41J 2/17596* (2013.01); *B41J 2/175* (2013.01); *B41J 2/18* (2013.01)

(58) Field of Classification Search
CPC ..... B41J 2/18; B41J 2/175; B41J 2/17596
See application file for complete search history.

(56) References Cited

U.S. PATENT DOCUMENTS

2008/0018715 A1 1/2008 Wee et al.
2011/0169897 A1 7/2011 Yokoyama et al.
2011/0228012 A1 9/2011 Yoshida et al.
2011/0234706 A1 9/2011 Yoshida et al.
2014/0078224 A1 3/2014 Park et al.

FOREIGN PATENT DOCUMENTS

EP 1 862 311 A1 12/2007
EP 2 050 572 A2 4/2009
JP 2001-063047 A 3/2001
JP 2011-213094 A 10/2011
JP 2011-224971 A 11/2011

OTHER PUBLICATIONS

Extended European Search Report for Application No. EP 18 16 2117 dated Jul. 30, 2018 (9 pages).

*Primary Examiner* — Lamson D Nguyen
(74) *Attorney, Agent, or Firm* — Harness, Dickey & Pierce, P.L.C.

(57) ABSTRACT

A liquid discharge apparatus includes a liquid chamber communicating with a nozzle that discharges liquid; a capacity changer that changes a capacity of the chamber; an inflow path connected to the chamber allowing the liquid to enter the chamber; an outflow path connected to the liquid chamber allowing the liquid to exit the chamber; a first resistance changer changing a flow resistance of the inflow path; a second resistance changer changing a flow resistance of the outflow path; and a controller controlling the capacity changer, the first resistance changer, and the second resistance changer. The controller allows the nozzle to discharge the liquid by increasing the flow resistance of the inflow and outflow paths, increasing the capacity of the chamber, and then, while the flow resistance of the inflow and outflow paths remain increased, decreasing the capacity of the chamber.

4 Claims, 7 Drawing Sheets

LIQUID DISCHARGE APPARATUS AND LIQUID DISCHARGE METHOD

BACKGROUND

1. Technical Field

The present invention relates to a liquid discharge apparatus and a liquid discharge method.

2. Related Art

Heretofore, as exemplified in a circulation-type ink jet apparatus disclosed in JP-A-2011-213094, a technique that, in order to reduce a phenomenon in which a driving force of an actuator for allowing ink inside an ink chamber to be discharged escapes into an ink outlet flow path in communication with the ink chamber, allows the flow-path resistance of the ink outlet flow path to be increased during the execution of the discharge of the ink has been employed.

For such a technique disclosed in JP-A-2011-213094, however, when the flow-path resistance of the ink outlet flow path is increased, the ink flows back from the ink outlet flow path into the ink chamber along with the variation of the capacity of the ink outlet flow path and, as a result, the ink is likely to leak through a nozzle in communication with the ink chamber. Further, for the technique disclosed in JP-A-2011-213094, a pressure applied to the ink chamber during the execution of the discharge of the ink is likely to escape into an ink supply flow path, and thus, the ink is likely not to be appropriately discharged. For this reason, a technique that enables the ink to be appropriately discharged along with the minimization of the phenomenon in which useless ink leaks through the nozzle has been required. This requirement has not been limited to such a circulation-type ink jet apparatus that discharges ink, but has been common to overall liquid discharge apparatuses capable of discharging liquid.

SUMMARY

An advantage of some aspects of the invention is that a liquid discharge apparatus and a liquid discharge method are provided that enable the achievement of the appropriate discharge of liquid along with the minimization of the phenomenon in which useless liquid leaks through a nozzle.

(1) According to one aspect of the invention, a liquid discharge apparatus is provided, and this liquid discharge apparatus includes a liquid chamber in communication with a nozzle configured to discharge liquid through the nozzle; a capacity change portion configured to change a capacity of the liquid chamber; an inflow path connected to the liquid chamber and configured to allow the liquid to be flown into the liquid chamber; an outflow path connected to the liquid chamber and configured to allow the liquid to be flown out from the liquid chamber; a first flow-path resistance change portion configured to change a flow-path resistance of the inflow path; a second flow-path resistance change portion configured to change a flow-path resistance of the outflow path; and a controller configured to control the capacity change portion, the first flow-path resistance change portion, and the second flow-path resistance change portion. Further, the controller allows the liquid to be discharged through the nozzle by controlling the first flow-path resistance change portion and the second flow-path resistance change portion to increase the flow-path resistance of the inflow path and the flow-path resistance of the outflow path, controlling the capacity of the liquid chamber to increase the capacity of the liquid chamber, and then, in a state in which the flow-path resistance of the inflow path and the flow-path resistance of the outflow path remain increased, controlling the capacity change portion to decrease the capacity of the liquid chamber.

Any liquid discharge apparatus configured in such a way as described above enables the minimization of the phenomenon in which the flown-back liquid leaks through the nozzle because, in such a liquid discharge apparatus, when the flow-path resistance of the outflow path is increased, even though the liquid existing inside the outflow path flows back into the liquid chamber, the capacity of the liquid chamber is increased. Moreover, the liquid discharge apparatus configured in such a way as described above enables the minimization of the phenomenon in which a pressure for discharging the liquid escapes into the inflow path and the outflow path because, in such a liquid discharge apparatus, the liquid is discharged in a state in which both of the flow-path resistance of the outflow path and the flow-path resistance of the inflow path remain increased. Accordingly, the appropriate discharge of the liquid along with the minimization of the phenomenon in which useless liquid leaks through the nozzle is achieved.

(2) In the liquid discharge apparatus according to the one aspect of the invention, the controller may allow the liquid to be discharged through the nozzle by executing filling control for controlling the second flow-path resistance change portion to increase the flow-path resistance of the outflow path so as to allow the flow-path resistance of the outflow path to be larger than the flow-path resistance of the inflow path, and for controlling the capacity change portion to increase the capacity of the liquid chamber, and by, after the execution of the filling control, executing discharge control for controlling the first flow-path resistance change portion to increase the flow-path resistance of the inflow path in a state in which the flow-path resistance of the outflow path remains increased, and for controlling the capacity change portion to decrease the capacity of the liquid chamber. Any liquid discharge apparatus configured in such a way as described above enables the achievement of the appropriate discharge of the liquid along with the minimization of the phenomenon in which useless liquid escapes through the nozzle.

(3) In the liquid discharge apparatus according to the one aspect of the invention, before the execution of the filling control, the controller may allow a pressure of the liquid inside the liquid chamber to be lower than or equal to a withstand pressure of meniscus of the liquid inside the nozzle by executing waiting control for controlling the first flow-path resistance change portion to allow the liquid to be flown into the liquid chamber through the inflow path, and for allowing the flow-path resistance of the inflow path to be larger than the flow-path resistance of the outflow path. Any liquid discharge apparatus configured in such a way as described above enables the minimization of the phenomenon in which the liquid leaks through the nozzle in the waiting state.

In addition to the one aspect of the invention, as the liquid discharge apparatus described above, there exist various other aspects of the invention. As the other aspects of the invention, there exist a liquid discharge method performed by the liquid discharge apparatus, a computer program for controlling the liquid discharge apparatus, a non-temporal and tangible recording medium in which the computer program is recorded, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
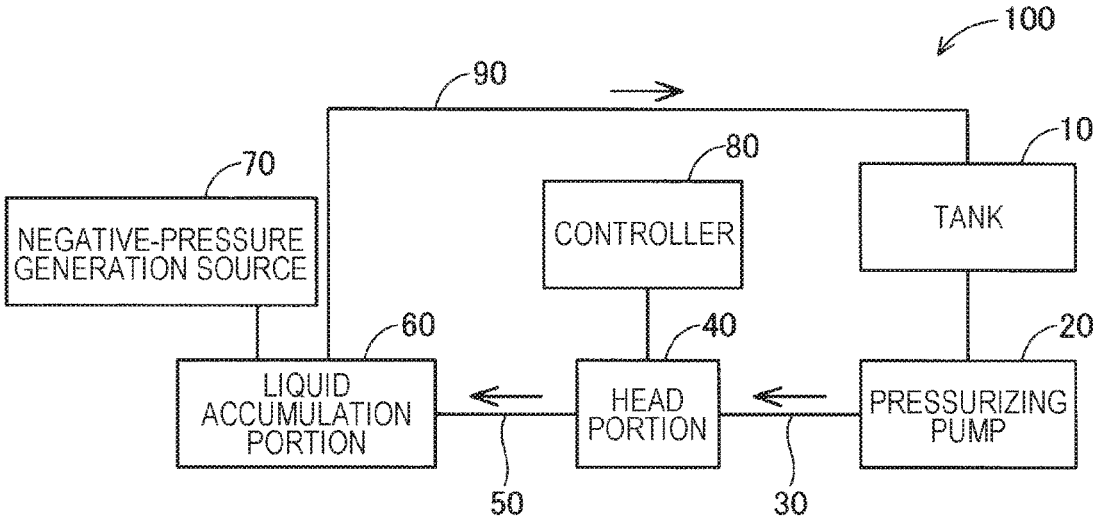
FIG. 1 is an explanatory diagram illustrating an outline configuration of a liquid discharge apparatus according to a first embodiment of the invention.

FIG. 1 is an explanatory diagram illustrating an outline configuration of a liquid discharge apparatus 100 in a first embodiment of the invention. The liquid discharge apparatus 100 includes a tank 10, a pressurizing pump 20, an inflow path 30, a head portion 40, an outflow path 50, a liquid accumulation portion 60, a negative-pressure generation source 70, and a controller 80.

The tank 10 contains liquid. As the liquid, for example, ink having a predetermined degree of viscosity is contained. The liquid inside the tank 10 is supplied to the head portion 40 through the inflow path 30 by the pressurizing pump 20. The liquid having been supplied to the head portion 40 is discharged by the head portion 40. The operation of the head portion 40 is controlled by the controller 80.

Liquid that has not been discharged by the head portion 40 is exhausted into the liquid accumulation portion through the outflow path 50. The liquid accumulation portion 60 is connected to the negative-pressure generation source 70 that can be constituted by one of various kinds of pumps. The negative-pressure generation source 70 makes the pressure inside the liquid accumulation portion 60 negative to cause the liquid to be sucked from the head portion 40 through the outflow path 50. The pressurizing pump 20 and the negative-pressure generation source 70 serve as a liquid supply portion for allowing a pressure difference to arise between the inflow path 30 and the outflow path 50 so as to supply the ink into the inflow path 30. In this case, both of the pressurizing pump 20 and the negative-pressure generation source 70 are not necessary to constitute the liquid supply portion, and the liquid supply portion may be constituted by a single component, that is, either the pressurizing pump 20 or the negative-pressure generation source 70. As described above, in the present embodiment, the liquid that has not been discharged from the head portion 40 is exhausted from the head portion 40 to the outflow path 50, and thus, a phenomenon in which precipitated components inside the liquid are accumulated in the head portion 40 is reduced.

In the present embodiment, the liquid accumulation portion 60 and the tank 10 are interconnected by a circulation path 90. The liquid having been accumulated in the liquid accumulation portion 60 is returned to the tank 10 through the circulation path 90, and is supplied to the head portion 40 again by the pressurizing pump 20. A pump for sucking the liquid in from the liquid accumulation portion 60 may be provided at a midway portion of the circulation path 90. Note that the liquid discharge apparatus 100 may be also configured such that the circulation path 90 is omitted so as not to cause the liquid be circulated.

Figure 2:
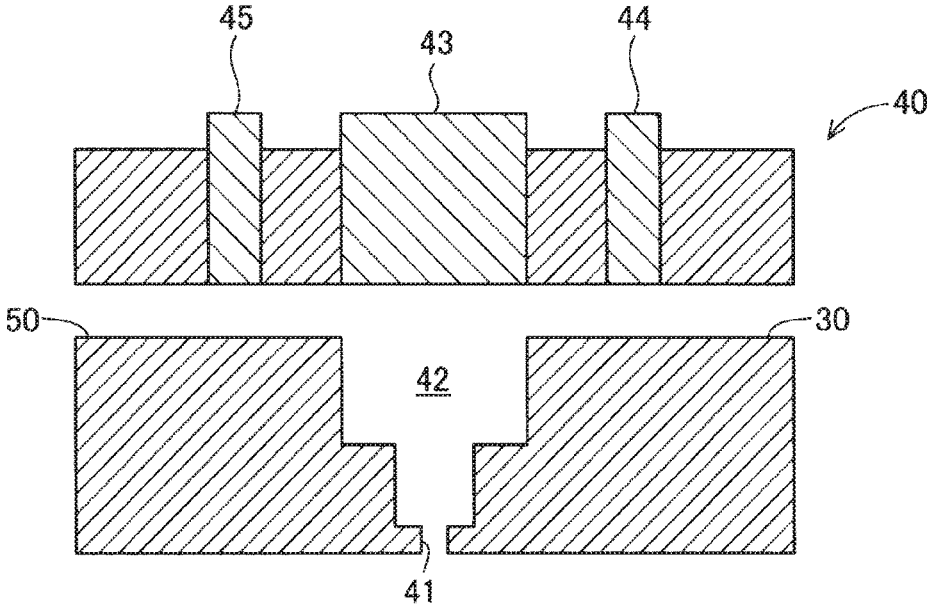
FIG. 2 is an explanatory diagram illustrating an outline configuration of a head portion in the first embodiment.

FIG. 2 is an explanatory diagram illustrating an outline configuration of the head portion 40. It is assumed that a direction toward the lower portion of FIG. 2 corresponds to a downward direction in the gravity direction. The head portion 40 includes a nozzle 41, a liquid chamber 42, a capacity change portion 43, a first flow-path resistance change portion 44, and a second flow-path resistance change portion 45.

The liquid chamber 42 is a chamber into which liquid is supplied. The liquid chamber 42 is in communication with the nozzle 41 through which the liquid is discharged to the outside. The inflow path 30 and the outflow path 50 are connected to the liquid chamber 42. The liquid chamber 42 and the nozzle 41 are produced by, for example, forming a space inside a metallic material.

In a portion above the liquid chamber 42, the capacity change portion 43 for changing the capacity of the liquid chamber 42 is provided. The capacity change portion 43 can be constituted by a piston movable in an upper-lower direction inside the liquid chamber 42 and a lamination-type piezoactuator for driving the piston in the upper-lower direction.

The inflow path 30 is a flow path which is connected to the liquid chamber 42 and through which the liquid is flown into the liquid chamber 42. At a midway portion of the inflow path 30, there is provided the first flow-path resistance change portion 44 for changing the flow-path resistance of the inflow path 30. The first flow-path resistance change portion 44 can be constituted by, for example, a piston movable in an upper-lower direction inside the inflow path 30 and a lamination-type piezoactuator for driving the piston in the upper-lower direction.

The outflow path 50 is a flow path which is connected to the liquid chamber 42 and through which the liquid is flown out from the liquid chamber 42. At a midway portion of the outflow path 50, there is provided the second flow-path resistance change portion 45 for changing the flow-path resistance of the outflow path 50. The second flow-path resistance change portion 45 can be constituted by, for example, a piston movable in an upper-lower direction inside the outflow path 50 and a lamination-type piezoactuator for driving the piston in the upper-lower direction.

The capacity change portion 43, the first flow-path resistance change portion 44, and the second flow-path resistance change portion 45 are connected to the controller (FIG. 1). The controller 80 controls the capacity change portion 43, the first flow-path resistance change portion 44, and the second flow-path resistance change portion 45. The controller 80 allows the liquid to be discharged through the nozzle 41 by controlling the first flow-path resistance change portion 44 and the second flow-path resistance change portion 45 to increase the flow-path resistances of the inflow path 30 and the outflow path 50; controlling the capacity change portion 43 to increase the capacity of the liquid chamber 42; and then, in a state in which the flow-path resistances of the inflow path 30 and the outflow path 50 remain increased, controlling the capacity change portion 43 to decrease the capacity of the liquid chamber 42. The detailed content of processes by the controller 80 will be described later. The controller 80 is configured as a computer including a CPU and a memory, and achieves various processes described later by executing a control program stored in the memory. In this case, the control program may be recorded in one of various non-temporal and tangible recording media.

In the following description, a maximum flow-path resistance of the inflow path 30 and a maximum flow-path resistance of the outflow path 50 respectively mean a maximum flow-path resistance adjustable by the first flow-path resistance change portion 44 and a maximum flow-path resistance adjustable by the second flow-path resistance change portion 45. Further, a minimum flow-path resistance of the inflow path 30 and a minimum flow-path resistance of the outflow path 50 respectively mean a minimum flow-path resistance adjustable by the first flow-path resistance change portion 44 and a minimum flow-path resistance adjustable by the second flow-path resistance change portion 45. In the case where the flow-path resistance of the inflow path 30 is set to its maximum flow-path resistance, the inflow path 30 is preferable to be blocked off, and in the case where the flow-path resistance of the outflow path 50 is set to its maximum flow-path resistance, the outflow path 50 is preferable to be blocked off. Further, a minimum capacity of the liquid chamber 42 is a minimum capacity adjustable by the capacity change portion 43 with respect to the capacity of the liquid chamber 42, and a maximum capacity of the liquid chamber 42 is a maximum capacity adjustable by the capacity change portion 43 with respect to the capacity of the liquid chamber 42.

Figure 3:
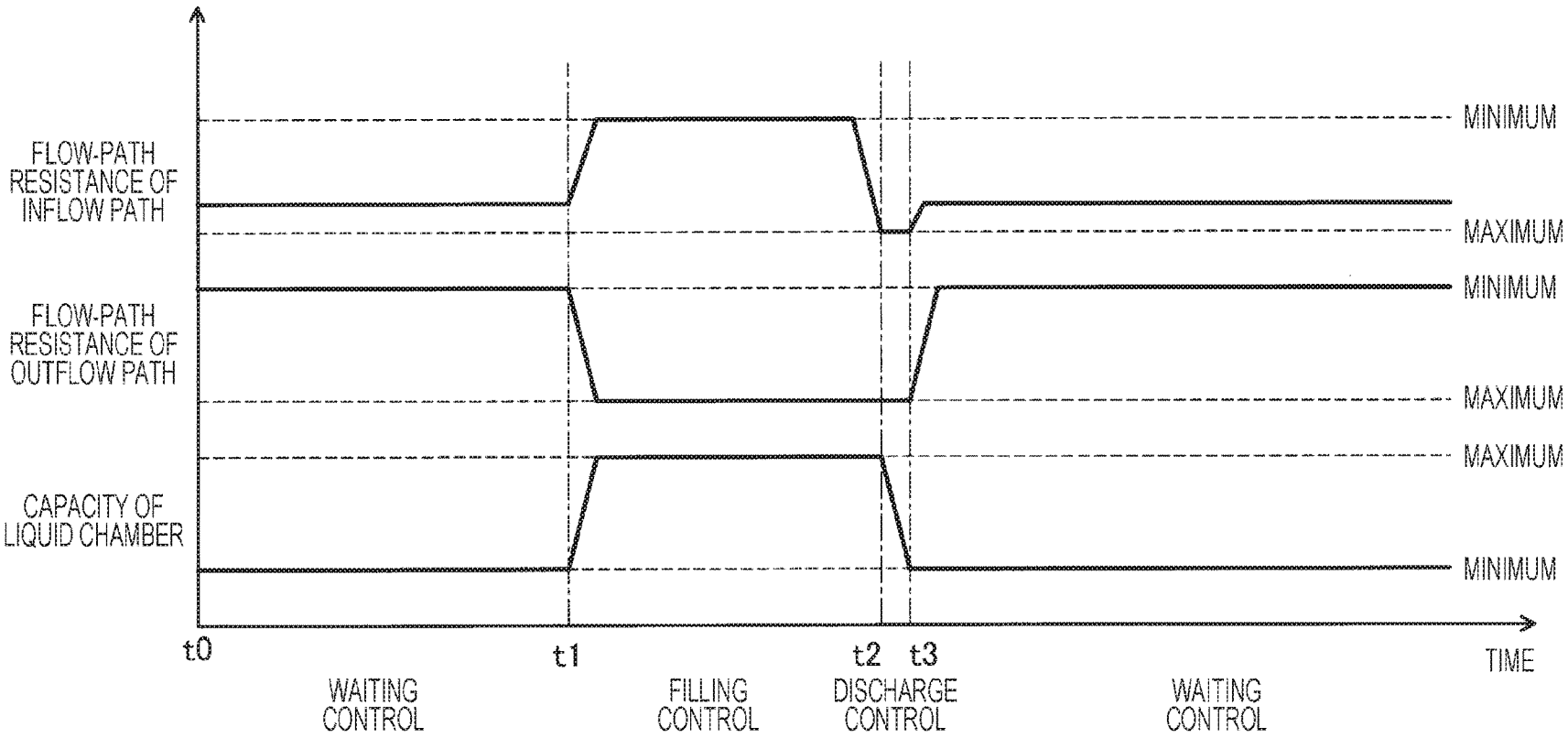
FIG. 3 is a timing chart illustrating the process content of a liquid discharge method in the first embodiment.

FIG. 3 is a timing chart illustrating the process content of a liquid discharge method performed by the controller 80. In FIG. 3, a horizontal axis indicates an elapse time, and a vertical axis indicates the flow-path resistance of the inflow path 30, the flow-path resistance of the outflow path 50, and the capacity of the liquid chamber 42.

First, during a period from a timing point t0 until a timing point t1, these timing points being illustrated in FIG. 3, the controller 80 allows the pressure of the liquid inside the liquid chamber 42 to be lower than or equal to a meniscus withstand pressure of the liquid inside the nozzle by executing waiting control for controlling the first flow-path resistance change portion 44 to allow the liquid to be flown into the liquid chamber 42 through the inflow path 30 and allow the flow-path resistance of the inflow path 30 to be larger than the flow-path resistance of the outflow path 50. More specifically, in the present embodiment, the controller 80 allows the flow-path resistance of the inflow path 30 to be equal to its middle flow-path resistance smaller than its maximum flow-path resistance; allows the flow-path resistance of the outflow path 50 to be equal to its minimum flow-path resistance; and further, allows the capacity of the liquid chamber 42 to be equal to its minimum capacity. In the present embodiment, the middle flow-path resistance is a flow-path resistance that enables the pressure of the liquid flown in from the tank 10 to be decreased to a pressure lower than or equal to the meniscus withstand pressure of the liquid inside the nozzle 41. Through this waiting control, the liquid having been supplied from the tank 10 is adjusted to an appropriate pressure, and then is flown out to the liquid accumulation portion 60 through the liquid chamber 42. Note that the meniscus withstand pressure means a maximum pressure among pressures at which the meniscus of the liquid is not destroyed (that is, a maximum pressure among pressures that can be withstood by the meniscus).

After the execution of the waiting control, during a period from the timing point t1 until a timing point t2, the controller 80 executes filling control for controlling the second flow-path resistance change portion 45 to allow the flow-path resistance of the outflow path 50 to be larger than the flow-path resistance of the inflow path 30, and for controlling the capacity change portion 43 to increase the capacity of the liquid chamber 42. More specifically, in the present embodiment, the controller 80 decreases the flow-path resistance of the inflow path 30 from its middle flow-path resistance to its minimum flow-path resistance; increases the flow-path resistance of the outflow path 50 from its minimum flow-path resistance to its maximum flow-path resistance; and increases the capacity of the liquid chamber 42 from its minimum capacity to its maximum capacity. Through this filling control, the liquid for use in the execution of the discharge is filled into the liquid chamber 42 and the nozzle 41.

After the liquid has been filled into the liquid chamber 42 and the nozzle 41 through the filling control, during a period from the timing point t2 until a timing point t3, the controller 80 executes discharge control for, in a state in which the flow-path resistance of the outflow path 50 remains increased, controlling the first flow-path resistance change portion 44 to increase the flow-path resistance of the inflow path 30, and for controlling the capacity change portion 43 to decrease the capacity of the liquid chamber 42. More specifically, in the present embodiment, the controller 80 increases the flow-path resistance of the inflow path 30 from its minimum flow-path resistance to its maximum flow-path resistance in a state in which the flow-path resistance of the outflow path 50 remains equal to its maximum flow-path resistance, and rapidly decreases the capacity of the liquid chamber 42 from its maximum flow-path resistance to its minimum flow-path resistance in a state in which the flow-path resistance of the inflow path 30 remains equal to its maximum flow-path resistance and the flow-path resistance of the outflow path remains equal to its maximum flow-path resistance. Through the execution of the discharge control, the liquid is discharged through the nozzle 41 in communication with the liquid chamber 42. Note that, in the discharge control, the rapid decrease of the capacity of the liquid chamber 42 allows the pressure of the liquid inside the nozzle 41 to become a pressure exceeding the meniscus withstand pressure, thereby allowing the liquid to be discharged through the nozzle 41.

After the discharge of the liquid through the nozzle 41, the controller 80 executes the waiting control after the timing point t3. More specifically, in the present embodiment, the controller 80 executes the waiting control for decreasing the flow-path resistance of the inflow path 30 from its maximum flow-path resistance to its middle flow-path resistance; decreasing the flow-path resistance of the outflow path 50 from its maximum flow-path resistance to its minimum flow-path resistance; and decreasing the capacity of the liquid chamber 42 from its maximum capacity to its minimum capacity. Through this waiting control, as a result, the liquid having been supplied from the tank 10 is flown out again to the liquid accumulation portion 60 through the liquid chamber 42. The controller 80 is capable of continually discharging the liquid in the form of liquid droplets through the nozzle 41 by repeatedly executing the above-described processing.

Figure 4:
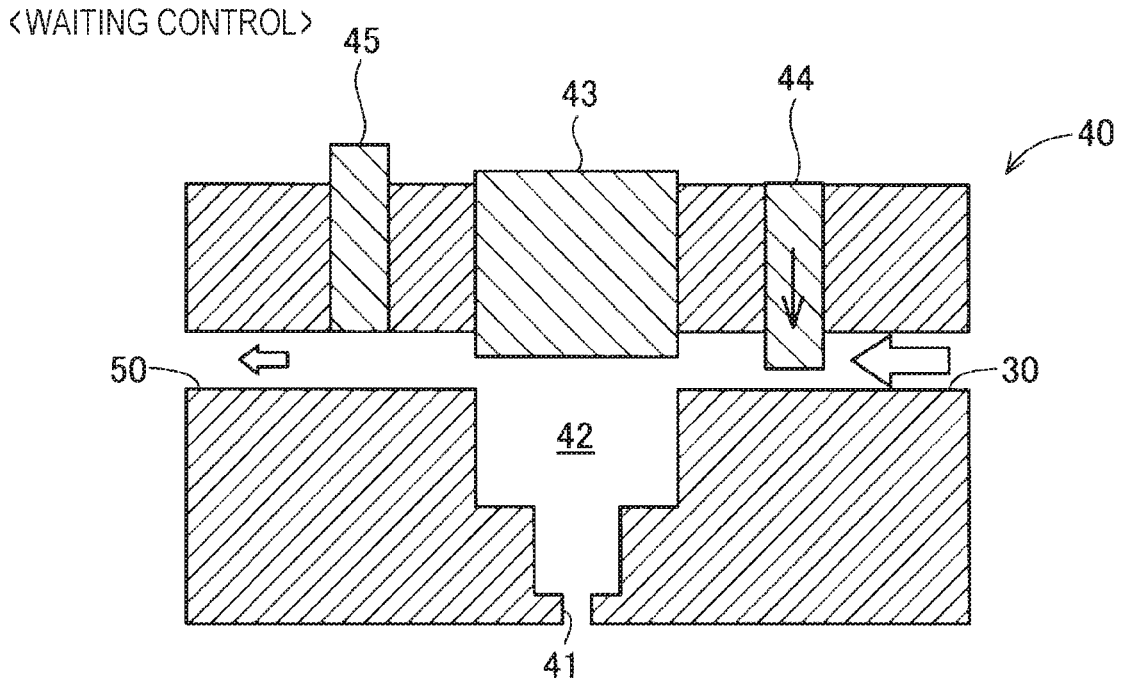
FIG. 4 is a diagram illustrating the operation of the head portion in the first embodiment.
Figure 5:
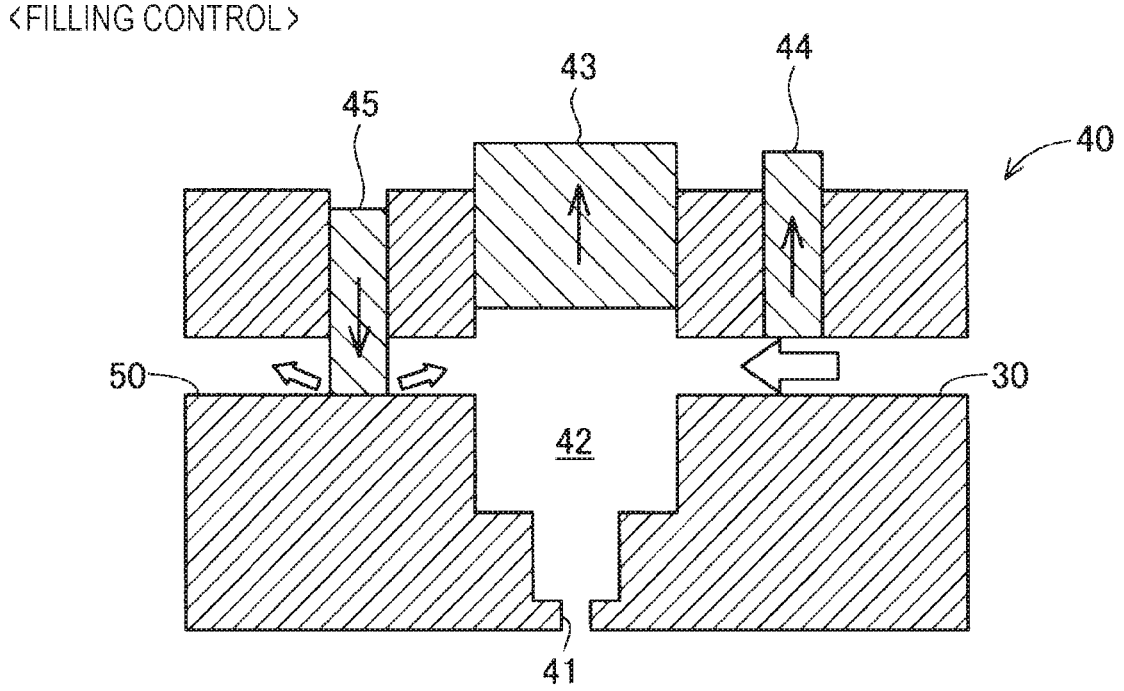
FIG. 5 is a diagram illustrating the operation of the head portion in the first embodiment.
Figure 6:
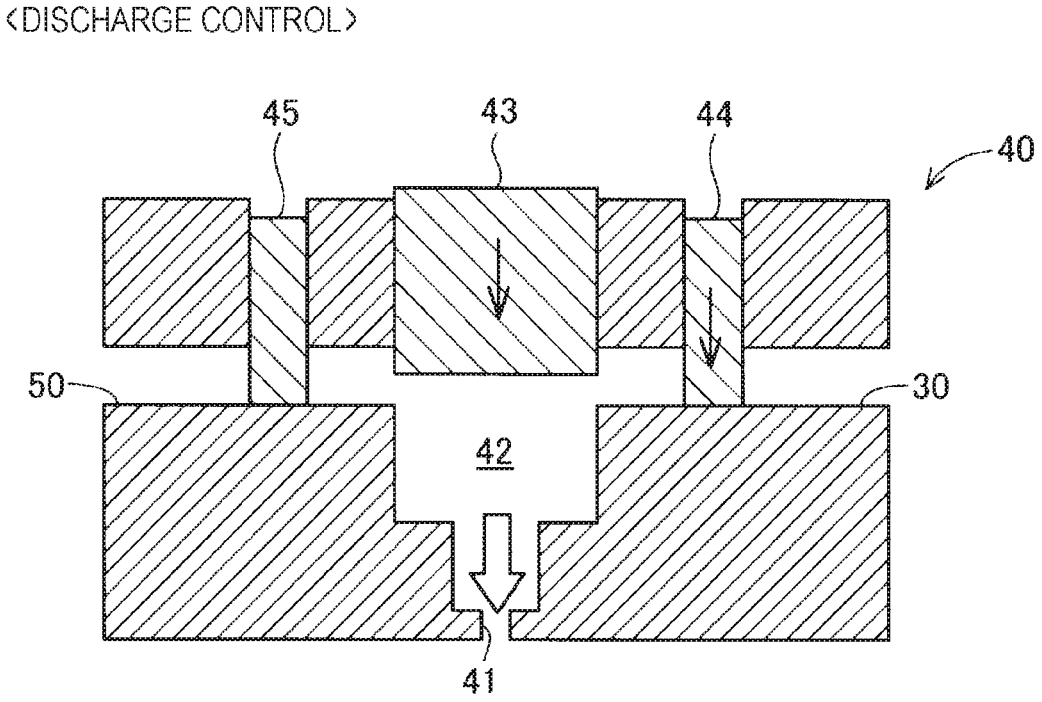
FIG. 6 is a diagram illustrating the operation of the head portion in the first embodiment.

FIGS. 4 to 6 are diagrams illustrating the operations of the head portion 40 in the present embodiment. In the above-described liquid discharge apparatus 100 of the present embodiment, in the waiting control before the execution of the filling control, as illustrated in FIG. 4, the pressure of the liquid having been flown into the liquid chamber 42 is decreased so as to become lower than or equal to the meniscus withstand pressure of the liquid inside the nozzle 41 by increasing the flow-path resistance of the inflow path 30 and setting the increased flow-path resistance of the inflow path 30 to its middle flow-path resistance. With this configuration, the liquid inside the liquid chamber 42 is not discharged through the nozzle 41, but is discharged through the outflow path 50 whose flow-path resistance has been set to its minimum flow-path resistance. Thus, in the waiting state, the phenomenon in which useless liquid leaks through the nozzle 41 is minimized.

Further, in the present embodiment, in the above-described filling control, as illustrated in FIG. 5, the flow-path resistance of the outflow path 50 is set to its maximum flow-path resistance and the flow-path resistance of the inflow path 30 is set to its minimum flow-path resistance, thus enabling the liquid to be efficiently filled into the liquid chamber 42 along with the minimization of a phenomenon in which the liquid is exhausted through the outflow path 50. Further, in the filling control, the capacity of the liquid chamber 42 is increased concurrently with the increase of the flow-path resistance of the outflow path 50, and thus, when the second flow-path resistance change portion 45 is pushed and inserted into the outflow path 50 to increase the flow-path resistance of the outflow path 50, even though the liquid existing immediately under the second flow-path resistance change portion 45 flows back into the liquid chamber 42, the flown-back liquid can be captured by the liquid chamber 42 whose capacity has been increased. Accordingly, the phenomenon in which the liquid having flown back from the outflow path 50 leaks through the nozzle 41 is minimized. As a result, the phenomenon in which useless liquid leaks through the nozzle 41 is minimized. Further, in the filling control, the flow-path resistance of the inflow path 30 is decreased concurrently with the increase of the capacity of the liquid chamber 42, and thus, the increase of the capacity of the liquid chamber 42 minimizes the phenomenon in which the liquid is drawn into the liquid chamber 42 from the side of the nozzle 41. Thus, in the execution of the discharge control, the occurrence of a discharge failure is minimized.

Further, in the present embodiment, in the above-described discharge control, as illustrated in FIG. 6, in a state in which the flow-path resistance 50 remains set to its maximum flow-path resistance, the flow-path resistance of the inflow path 30 is also set to its maximum flow-path resistance, and thus, the phenomenon in which the pressure for discharging the liquid escapes into the inflow path 30 and the outflow path 50 is minimized. Thus, the efficient discharge of the liquid is achieved.

Note that, in the present embodiment, the controller 80 allows the liquid to be filled into the liquid chamber 42 by executing the filling control for controlling the second flow-path resistance change portion 45 to allow the flow-path resistance of the outflow path 50 to be larger than the flow-path resistance of the inflow path 30 and for controlling the capacity change portion 43 to increase the capacity of the liquid chamber 42. For this configuration, for example, the controller 80 may allow the liquid to be filled into the liquid chamber 42 by controlling the capacity change portion 43 to increase the capacity of the liquid chamber 42 while controlling the first flow-path resistance change portion 44 and the second flow-path resistance change portion 45 to increase the flow-path resistances of both of the inflow path 30 and the outflow path 50. In this case as well, the capacity of the liquid chamber 42 is increased concurrently with the increase of the flow-path resistance of the outflow path 50, and thus, the phenomenon in which, when the flow-path resistance of the outflow path 50 is increased, the liquid having flown back from the outflow path 50 leaks through the nozzle 41 is minimized. The controller 80 may also execute such control in second and third embodiments described below.

B. Second Embodiment

Figure 7:
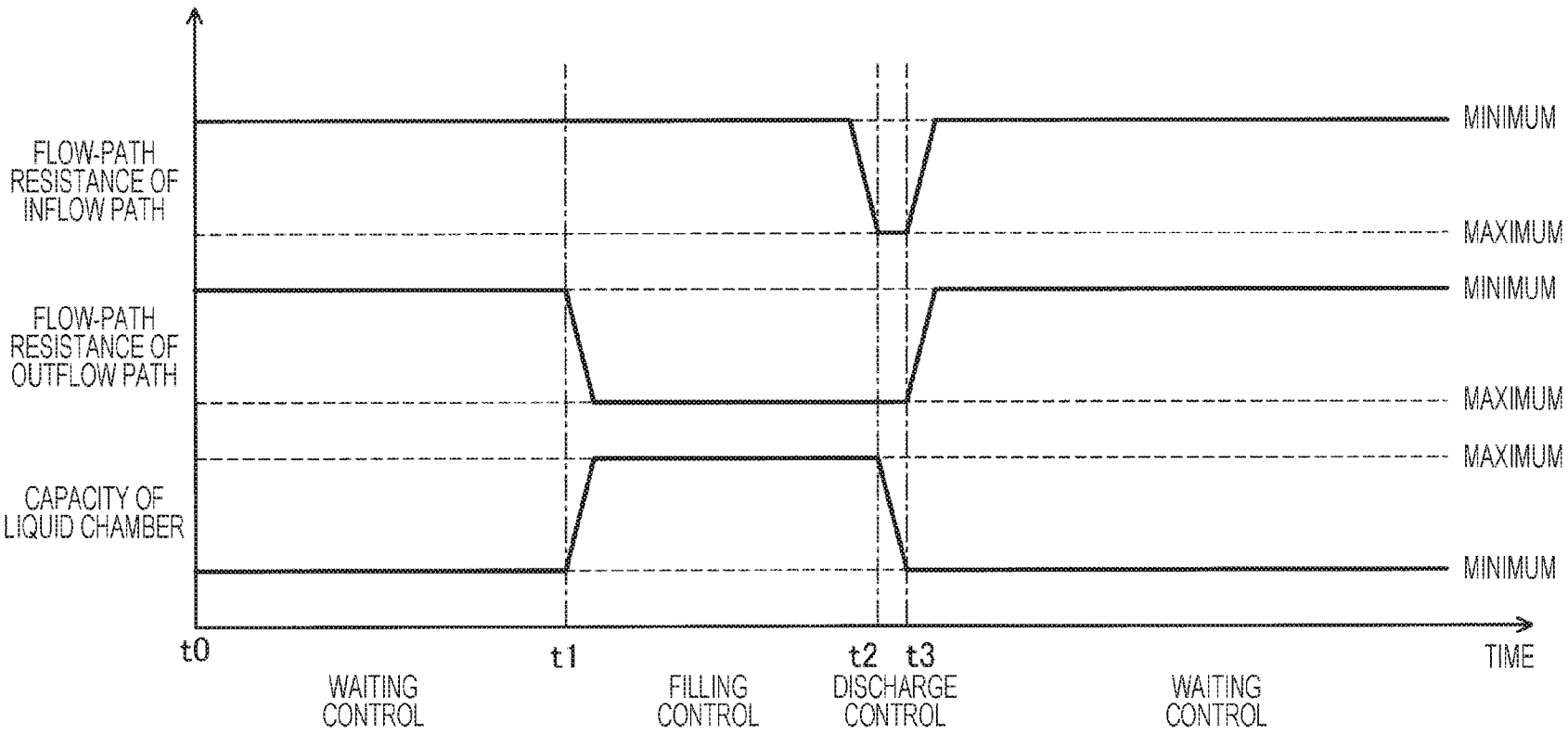
FIG. 7 is a timing chart illustrating the process content of a liquid discharge method in a second embodiment of the invention.
Figure 8:
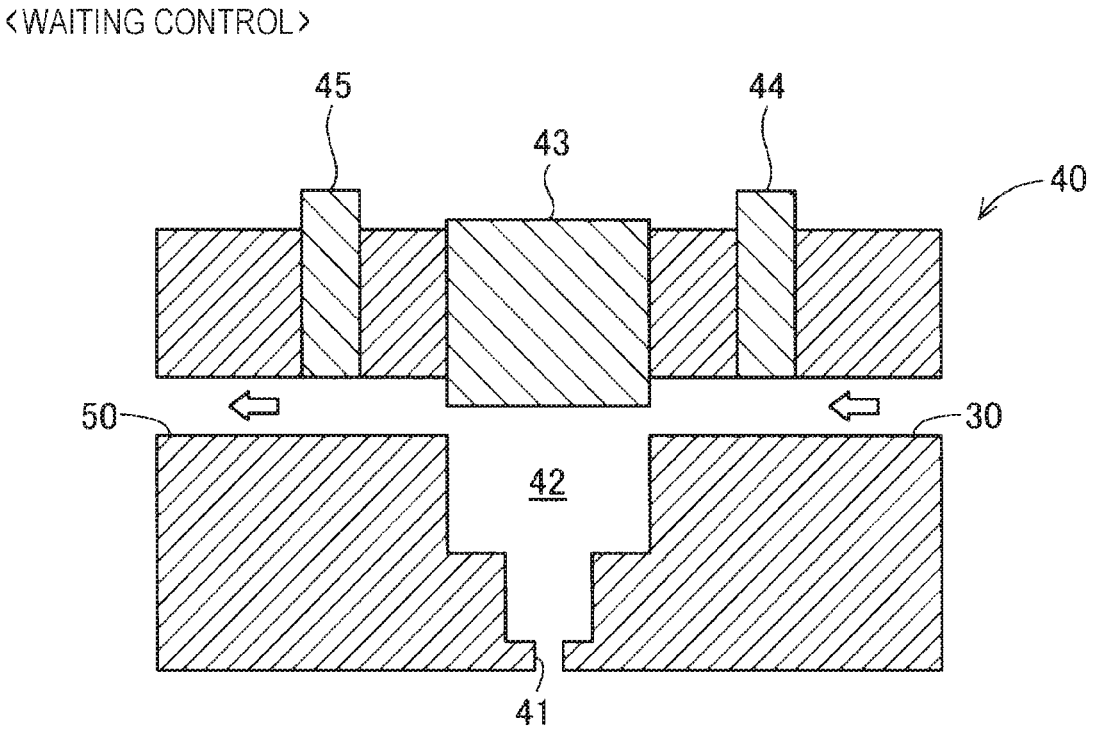
FIG. 8 is a diagram illustrating the operation of the head portion in the second embodiment.

FIG. 7 is a timing chart illustrating the process content of a liquid discharge method performed by the controller 80 in a second embodiment. FIG. 8 is a diagram illustrating the operation of the head portion 40 in the second embodiment. In the second embodiment, the content of the waiting control executed by the controller 80 is different from that of the first embodiment, and the contents of the other kinds of control and the configuration of the liquid discharge apparatus 100 are the same as those of the first embodiment.

As illustrated in FIG. 3, in the first embodiment, the controller 80 sets the flow-path resistance of the inflow path 30 to its middle flow-path resistance in the waiting control executed during a period from the timing point t0 until the timing point t1 and in the waiting control executed after the timing point t3. For this configuration, in the present embodiment, in the waiting control associated with the above timing points, as illustrated in FIGS. 7 and 8, the controller 80 controls the first flow-path resistance change portion 44 to set the flow-path resistance of the inflow path 30 to its minimum flow-path resistance.

In the above-described second embodiment as well, in the case where the pressure of the liquid having been supplied to the inflow path 30 from the tank 10 is lower than the meniscus withstand pressure of the liquid inside the nozzle 41, in the waiting state, the liquid can be flown out to the outflow path 50 without the leakage of the liquid through the nozzle 41. Thus, according to the second embodiment, the same advantageous effects as those of the first embodiment are also brought about.

C. Third Embodiment

Figure 9:
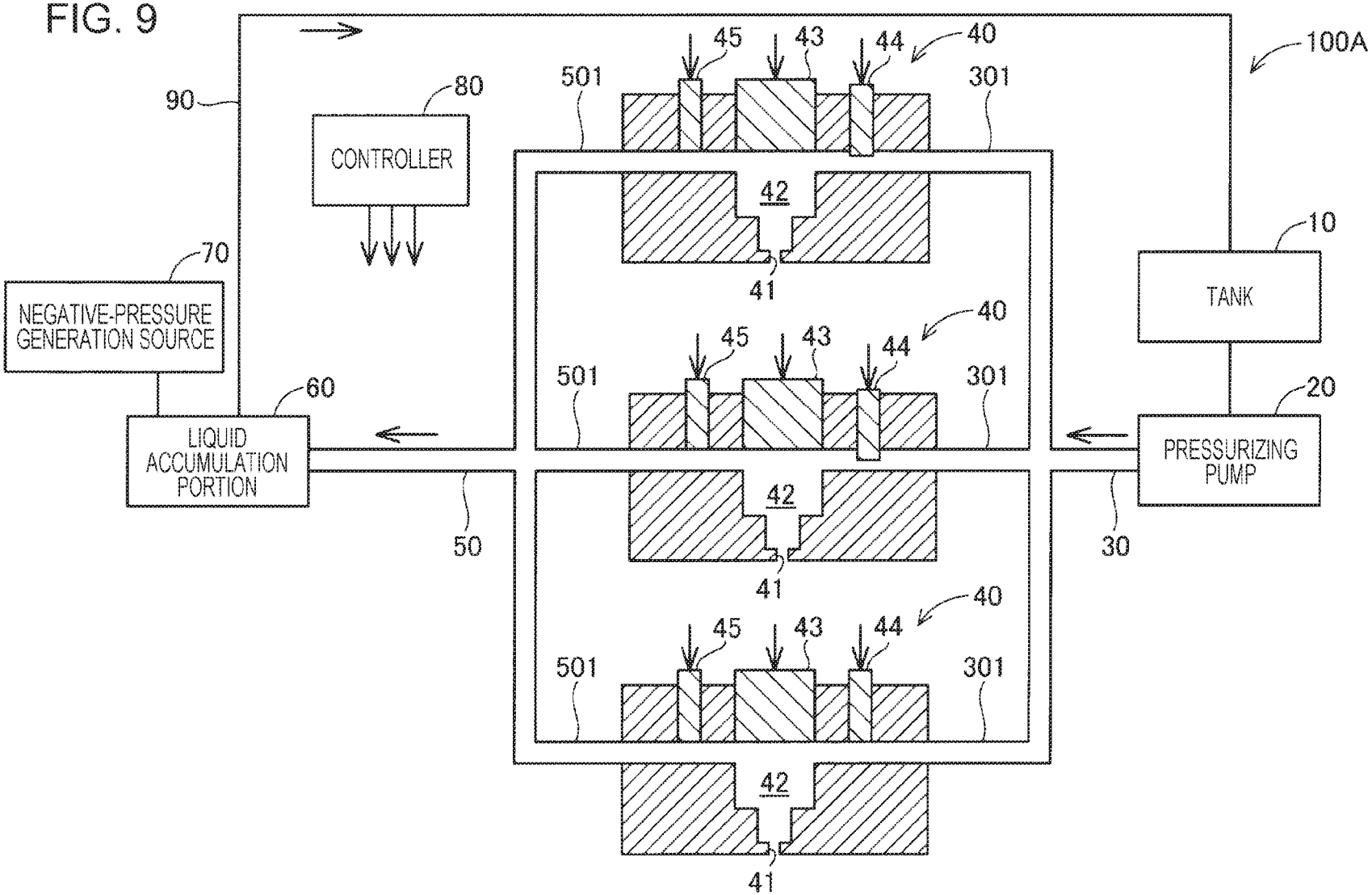
FIG. 9 is an explanatory diagram illustrating an outline configuration of a liquid discharge apparatus according to a third embodiment of the invention.

FIG. 9 is an explanatory diagram illustrating an outline configuration of a liquid discharge apparatus in a third embodiment. A liquid discharge apparatus 100A in the present embodiment includes a plurality of head portions 40. Thus, the liquid discharge apparatus 100A in the present embodiment includes a plurality of liquid chambers 42, and includes, for each of the liquid chambers 42, a branched inflow path 301, a branched outflow path 501, a capacity change portion 43, a first flow-path resistance change portion 44, and a second flow-path resistance change portion 45. The branched inflow path 301 corresponding to each of the liquid chambers 42 is connected to an inflow path 30, and the branched outflow path 501 corresponding to each of the liquid chambers 42 is connected to an outflow path 50.

A controller 80 is connected to the capacity change portion 43, the first flow-path resistance change portion 44, and the second flow-path resistance change portion 45, these components being included in each of the head portions 40, and the controller 80 controls the operations of these components in the same way as in the first embodiment or the second embodiment. Through the control of these components for each of the head portions 40, the controller 80 is capable of allowing the liquid to be individually discharged from the each of the head portions 40.

According to the above-described liquid discharge apparatus 100A in the third embodiment, the controller 80 is capable of individually controlling the first flow-path resistance change portions 44, and thus, for example, even when there are variations among the capacities of the respective liquid chambers 42, the weights and the sizes of liquids discharged from the respective liquid chambers 42 can be equalized with one another by individually adjusting the flow-path resistances of the respective branched inflow paths 301. For example, for a head portion 40 being among the head portions 40 and including a liquid chamber 42 whose capacity is smaller than those of liquid chambers 42 of the other head portions 40, the amount of liquid discharged through a nozzle 41 of the relevant head portion 40 can be equalized with the amounts of liquids discharged through the nozzles 41 of the other head portions 40 by, in the filling control, controlling the first flow-path resistance change portion 44 of the relevant head portion 40 to allow the flow-path resistance of a branched inflow path 301 corresponding to the relevant head portion 40 to be larger than those of branched inflow paths 301 corresponding to the other head portions 40 so as to decrease the liquid amount of the liquid flown into the liquid chamber 42 of the relevant head portion 40.

Note that, in the liquid discharge apparatus 100A illustrated in FIG. 9, the second flow-path resistance change portions 45 are individually provided for the respective head portions 40. For this configuration, for example, one second flow-path resistance change portion 45 may be provided at a midway portion of the outflow path 50, which results from joining of the branched outflow paths 501, and the one second flow-path resistance change portion 45 may be shared by the plurality of head portions 40.

D. Modification Examples

Modification Example 1

In the aforementioned embodiment, each of the capacity change portion 43, the first flow-path resistance change portion 44, and the second flow-path resistance change portion 45 is constituted by a piston and a lamination-type piezoactuator. For this configuration, each of these components may be constituted by the combination of an elastic material, such as a vibration plate or an elastic rubber material, and a bending-type piezoactuator.

Modification Example 2

In the aforementioned embodiment, each of the capacity change portion 43, the first flow-path resistance change portion 44, and the second flow-path resistance change portion 45 is constituted by a piezoactuator. For this configuration, however, without being limited to the piezoactuator, each of these components may be constituted by a different type of actuator using an air cylinder, a solenoid, a magnetostrictive material, or the like.

Modification Example 3

The invention is applicable to, not only the liquid discharge apparatus that discharges ink, but also any other liquid discharge apparatus that discharges liquid other than the ink. For example, the invention is applicable to the following various kinds of liquid discharge apparatuses:

(1) an image recording apparatus, such as a facsimile apparatus;
(2) a color material discharge apparatus for use in manufacturing color filters for an image display apparatus, such as a liquid crystal display;
(3) an electrode material discharge apparatus for use in forming electrodes of an organic electro luminescence (EL) display, a field emission display (FED), or the like;
(4) a liquid discharge apparatus that discharges liquid containing a living organic material for use in manufacturing biotips;
(5) a sample discharge apparatus serving as a precision pipette;
(6) a discharge apparatus for lubricating oil;
(7) a discharge apparatus for resign liquid;
(8) a liquid discharge apparatus that discharges lubricating oil onto a precision machine, such as a clock or a camera, in a pinpoint manner;
(9) a liquid discharge apparatus that discharges transparent resin liquid, such as ultraviolet-curing resign liquid, onto a substrate to form minute hemispherical lenses (optical lenses) and the like for use in optical communication components and the like;
(10) a liquid discharge apparatus that discharges acidic or alkaline etching liquid to perform etching of a substrate and the like; and
(11) a liquid discharge apparatus including a liquid discharge head that discharges any other kind of liquid droplet having a minute amount.

Here, the "liquid droplet" means a state of liquid discharged from the liquid discharge apparatus, and encompasses not only a particle-shaped liquid droplet and a tear-shaped liquid droplet, but also a liquid droplet having a trailing string-shaped tail. Further, as the "liquid" mentioned here, any material consumable by the liquid discharge apparatus is applicable. For example, as the "liquid", any material corresponding to a substance being in a liquid phase state is applicable. Materials being in a liquid state having a high or low viscosity, and materials being in a liquid state, such as sol, gel water, any other inorganic solvent, an organic solvent, a solution, a liquid resin, and a liquid metal (a metal melt), are also encompassed in the "liquid". Further, not only the liquid as one state of a substance, but also materials each obtained by dissolving, dispersing, or mixing particles of a functional material made of a solid material, such as a pigment material or metal particles, into a solvent, and any other similar material are encompassed in the "liquid". Non-limiting typical examples of the liquid include ink and liquid crystal. Here, the ink encompasses water-based ink, oil-based ink, and various compositions each being in a liquid state, such as gel ink and hot melt ink.

The invention is not limited to the aforementioned embodiments and modification examples, and can be achieved in various configurations within the scope not departing from the gist of the invention. For example, the technical features implemented in the embodiments and the modification examples and corresponding to the technical features in the individual configurations described in "Summary" in the present specification may be replaced or combined as needed in order to solve part or all of the disadvantages described above, or achieve part or all of the advantageous effects described above. Further, any technical feature that is not described as an essential technical feature in the present specification may be deleted as needed.

The entire disclosure of Japanese Patent Application No. 2017-062693, filed Mar. 28, 2017 is expressly incorporated by reference herein.

What is claimed is:

1. A liquid discharge apparatus comprising:

a liquid chamber fluidly communicating with a nozzle configured to discharge liquid through the nozzle;

a capacity change member configured to change a capacity of the liquid chamber;

an inflow path connected to the liquid chamber and configured to allow the liquid to be flown into the liquid chamber;

an outflow path connected to the liquid chamber and configured to allow the liquid to be flown out from the liquid chamber;

a first flow-path resistance change member configured to change a flow-path resistance of the inflow path;

a second flow-path resistance change member configured to change a flow-path resistance of the outflow path; and a controller configured to control the capacity change member, the first flow-path resistance change member, and the second flow-path resistance change member, wherein the controller is configured to perform a first operation in which the flow-path resistance of the outflow path is larger than the flow-path resistance of the inflow path while the flow-path resistance of the inflow path and the flow-path resistance of the outflow path increase by controlling the first flow-path resistance change member and the second flow-path resistance change member, and the capacity of the liquid chamber increases by controlling the capacity change member so as to fill the liquid in the liquid chamber, and after the controller performs the first operation, the controller is configured to perform a second operation in which the flow-path resistance of the outflow path remains increased and the flow-path resistance of the inflow path increases by controlling the first flow-path resistance change member and the second flow-path resistance change member, and the capacity of the liquid chamber decreases by controlling the capacity change portion so as to discharge the liquid from the nozzle.

2. The liquid discharge apparatus according to claim 1, wherein, before the controller performs the first operation, the controller is configured to perform a third operation in which the liquid continues to be filled in the liquid chamber while the flow-path resistance of the inflow path is larger than the flow-path resistance of the outflow path by controlling the first flow-path resistance change member and the second flow-path resistance change member so as to make a pressure of the liquid inside the liquid chamber to be lower than or equal to a withstand pressure of meniscus of the liquid inside the nozzle.

3. A liquid discharge method of a liquid discharge apparatus, the liquid discharge apparatus including:

a liquid chamber fluidly communicating with a nozzle configured to discharge liquid through the nozzle;

a capacity change member configured to change a capacity of the liquid chamber;

an inflow path connected to the liquid chamber and configured to allow the liquid to be flown into the liquid chamber;

an outflow path connected to the liquid chamber and configured to allow the liquid to be flown out from the liquid chamber;

a first flow-path resistance change member configured to change a flow-path resistance of the inflow path; and a second flow-path resistance change member configured to change a flow-path resistance of the outflow path, the method comprising:

performing a first operation in which the flow-path resistance of the outflow path is larger than the flow-path resistance of the inflow path while the flow-path resistance of the inflow path and the flow-path resistance of the outflow path increase by controlling the first flow-path resistance change member and the second flow-path resistance change member, and the capacity of the liquid chamber increases by controlling the capacity change member so as to fill the liquid in the liquid chamber; and after the first operation is performed, performing a second operation in which the flow-path resistance of the outflow path remains increased and the flow-path resistance of the inflow path increases by controlling the first flow-path resistance change member and the second flow-path resistance change member, and the capacity of the liquid chamber decreases by controlling the capacity change portion so as to discharge the liquid from the nozzle.

4. The liquid discharge method according to claim 3, wherein, before performing the first operation, performing a third operation in which the liquid continues to be filled in the liquid chamber while the flow-path resistance of the inflow path is larger than the flow-path resistance of the outflow path by controlling the first flow-path resistance change member and the second flow-path resistance change member so as to make a pressure of the liquid inside the liquid chamber to be lower than or equal to a withstand pressure of meniscus of the liquid inside the nozzle.

* * * * *